United States Patent [19]

Schrag

[11] 4,206,739

[45] Jun. 10, 1980

[54] CASING FOR THE LUBRICATION OF THE CAMSHAFT OF AN INTERNAL COMBUSTION ENGINE FOR AUTOMOTIVE VEHICLES

[75] Inventor: Rolf Schrag, Hemmingen, Fed. Rep. of Germany

[73] Assignee: Dr. Ing. h.c.F. Porsche A. G., Stuttgart, Fed. Rep. of Germany

[21] Appl. No.: 936,131

[22] Filed: Aug. 23, 1978

[30] Foreign Application Priority Data

Aug. 23, 1977 [DE] Fed. Rep. of Germany ..... 2737901

[51] Int. Cl.[2] ..... F01M 77/00; F01M 9/10

[52] U.S. Cl. ..... 123/196 R; 123/196 S; 184/6.9

[58] Field of Search ..... 123/196 R, 196 M, 196 S, 123/90.37, 90.38, 90.33; 184/6.2, 6.5, 6.9

[56] References Cited

U.S. PATENT DOCUMENTS

| | | | |
|---|---|---|---|
| 2,619,189 | 11/1952 | Witzky | 184/6.9 |
| 3,033,314 | 5/1962 | Wetterhahn | 184/6.9 |

FOREIGN PATENT DOCUMENTS

| | | | |
|---|---|---|---|
| 1225512 | 9/1966 | United Kingdom | 184/6.2 |

*Primary Examiner*—Ronald H. Lazarus
*Attorney, Agent, or Firm*—Craig & Antonelli

[57] ABSTRACT

A casing for the lubrication of a camshaft of an internal combustion engine for automotive vehicles is partially filled with lubricating oil to effect splash lubrication of cams carried by the camshaft and has at least one lateral overflow port to maintain the oil at a substantially constant level. The overflow port is configured so as to prevent removal of oil which is not in excess of the required amount as a result of the shifting of the oil due to a uphill or downhill inclination of the vehicle. According to a preferred embodiment, the overflow port has a horizontal lower wall which corresponds to the desired maximum level of oil when the vehicle is level and this lower wall is flanked by inclined walls which correspond to the desired maximum level when the vehicle is in uphill and downhill orientations, respectively. More particularly, the preferred overflow port embodiment has a trapezoidal configuration which flares toward a side of a casing facing the camshaft and merges into a cylindrical configuration.

3 Claims, 5 Drawing Figures

CASING FOR THE LUBRICATION OF THE CAMSHAFT OF AN INTERNAL COMBUSTION ENGINE FOR AUTOMOTIVE VEHICLES

BACKGROUND AND SUMMARY OF THE INVENTION

The invention relates to a casing for lubricating a camshaft of an internal combustion engine for automotive vehicles, especially for a top-positioned camshaft in an internal combustion engine of V-type construction, this casing being provided with at least one lateral overflow port to maintain the oil at a constant level.

A casing for the splash lubrication of a camshaft of an internal combustion engine for automotive vehicles has been known from U.S. Pat. No. 3,033,314. This casing is formed by an oil collecting chamber cast, in case of an internal combustion engine of V-type construction, between the cylinder rows in the crankcase and extending over the entire length of the crankcase; this collecting chamber is subdivided into sections by walls receiving the bearing units carrying the camshaft. The oil flowing into the oil collecting chamber is collected therein until the individual cams of the camshaft are partially immersed in the oil. The height of the oil level is determined by overflow bores, from which the oil is returned into the oil pan.

Such splash lubrication systems for the cams of camshafts have proven themselves relatively well under practical conditions and are therefore employed nowadays to an increasing extent. However, there is the disadvantage in this conventional camshaft casing that when the vehicle is moving up or down an incline the oil level is elevated along respectively one side of the oil collecting chamber and/or along respectively one side of its individual sections so that it exceeds the level of the overflow bores and thereby such an amount of oil is discharged via the overflow bores from the oil collecting chamber that an adequate lubrication of the cams shaft is no longer ensured.

It is an object of this invention to avoid this disadvantage by an economical measure and to provide a camshaft lubrication which ensures a flawless lubrication in all positions assumed by the vehicle.

According to the invention, this object is attained by providing that the overflow port has a configuration which flares in the manner of a conical shape toward the side facing away from the camshaft and extends at least approximately in parallel to the camshaft axis. Thereby, solely due to the alteration in the configuration of the overflow bores, a camshaft lubrication has been created which is functional in all positions of the vehicle, which ensures a high operating safety of the internal combustion engine with regard to camshaft lubrication, and which moreover is maintenance-free.

In a suitable embodiment of the invention, the overflow port has a trapezoidal configuration, which widens toward the side facing toward the camshaft, and merges subsequent thereto into a cylindrical configuration.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
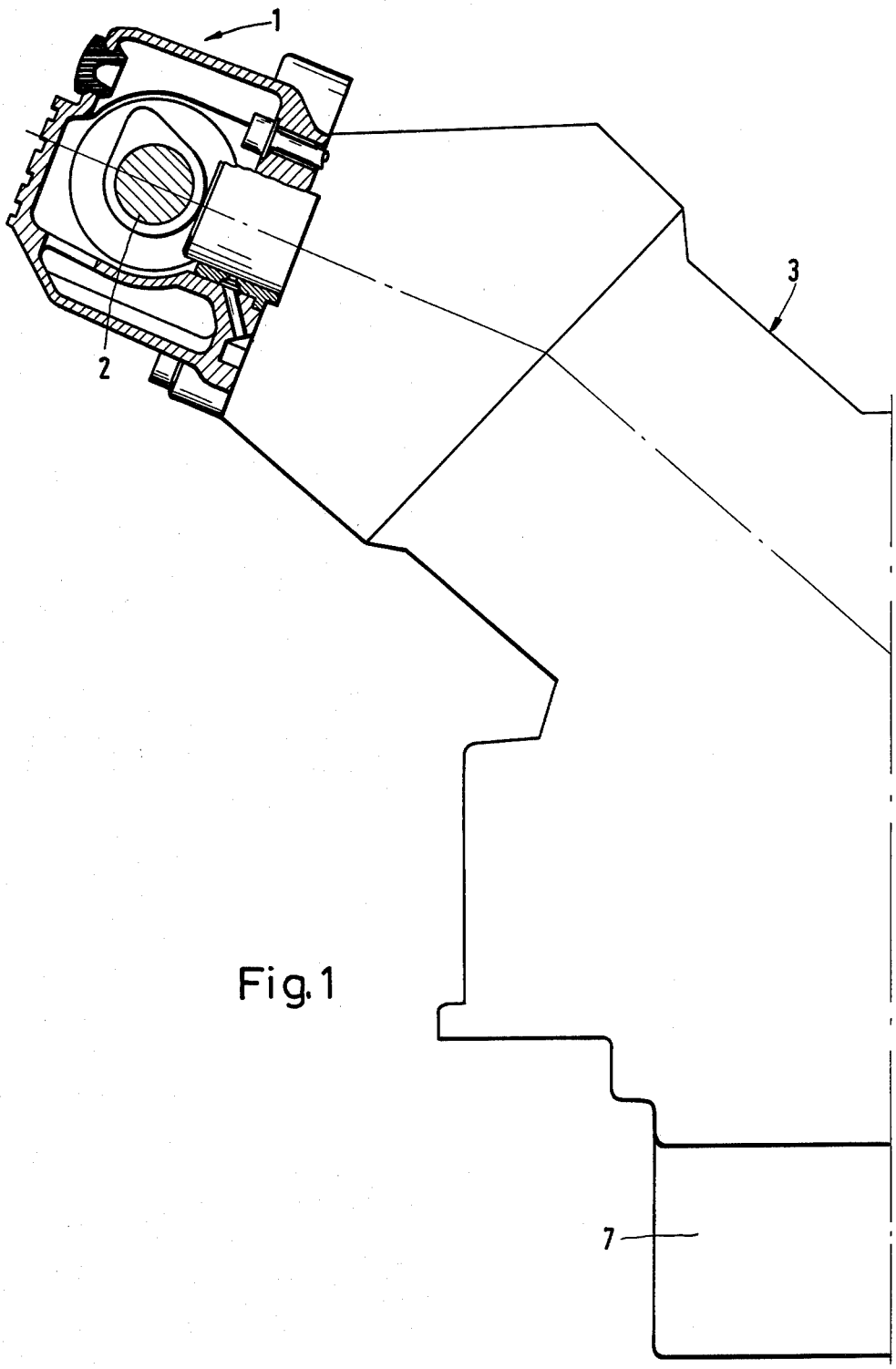
FIG. 1 shows the casing of this invention for the lubrication of a top-positioned camshaft of an internal combustion engine of the V-type construction, shown in a schematic view.
Figure 2:
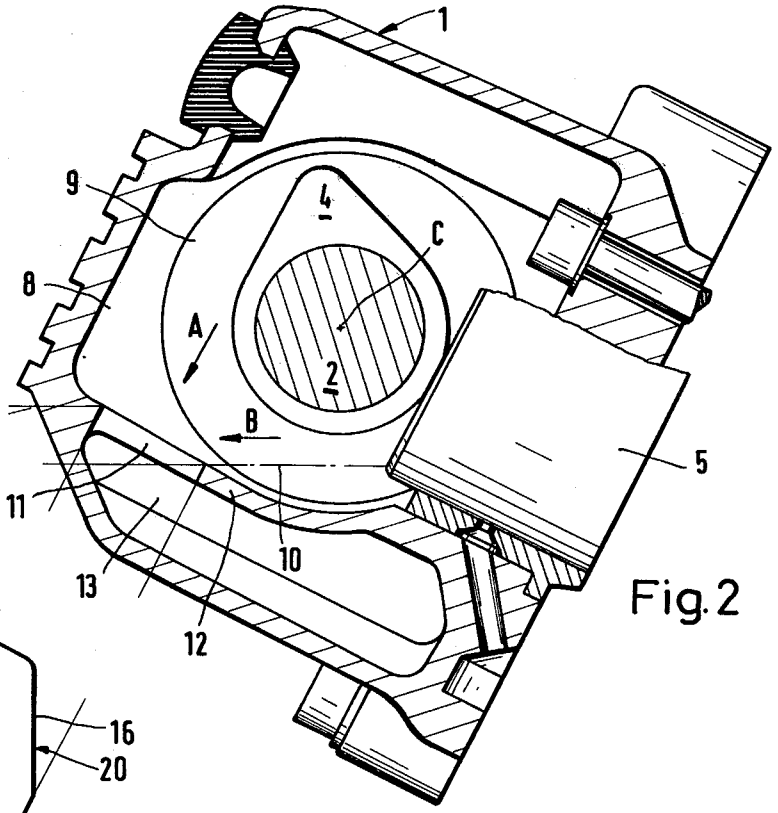
FIG. 2 shows the casing in a view as in FIG. 1 on an enlarged scale.
Figure 2A:
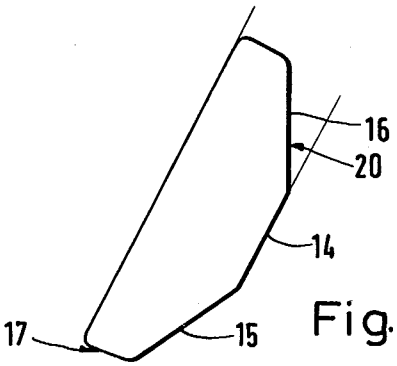
FIG. 2*a* shows a cross section of the overflow port in a view according to the direction of arrow A in FIG. 2.
Figure 2B:
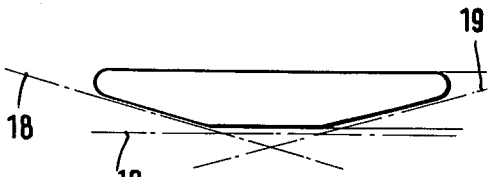
FIG. 2*b* shows the cross section of the overflow port affecting the oil level in the casing in dependence on the position of the vehicle, this cross section being projected in a view in the direction of arrow B.
Figure 3:
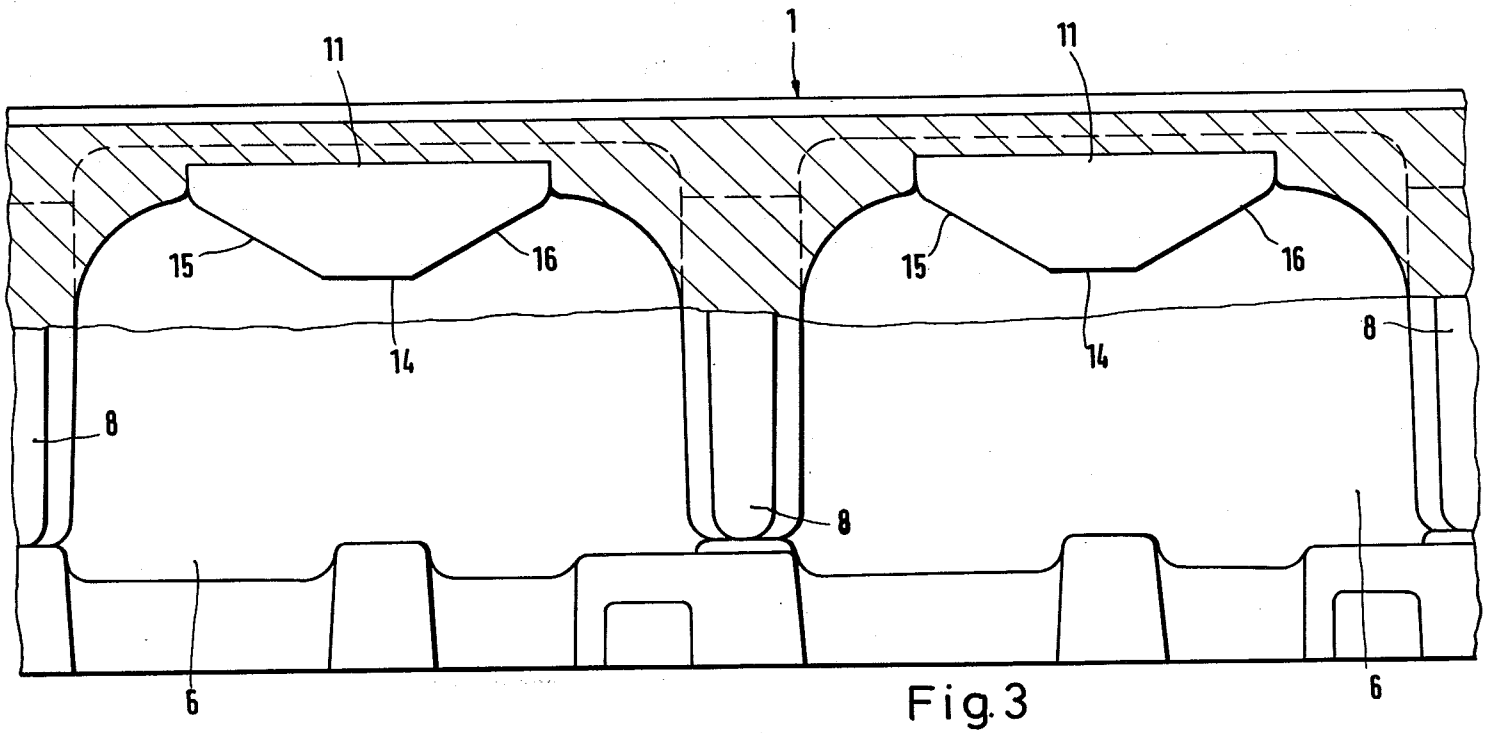
FIG. 3 shows a partial longitudinal section through the casing in the direction of arrow A in FIG. 2.

In FIGS. 1 and 2*b*, a casing formed by a camshaft housing is shown for the lubrication of a top-positioned camshaft of an internal combustion engine 3 of the V-type construction. By means of cams, denoted by 4, of the camshaft 2, valves, not shown, of the internal combustion engine 3 are actuated by way of hydraulic valve-clearance compensating elements 5. The casing 1 comprises advantageously several camshaft chambers 6 which can be respectively associated with one cylinder of the internal combustion engine 3, and to which is fed lubricating oil by suitable conventional means directly from the oil pan 7 of the internal combustion engine 3 or from a separate oil reservoir. The casing 1 is subdivided into the camshaft chambers 6 by means of walls 8 receiving the bearing units 9 carrying the camshaft 2. Once the oil level has reached the height in the camshaft chamber as indicated by the oil level line 10 (FIGS.2, 2*b*), this level is maintained constant by an overflow port 11 in a partition 12 of the casing 1. By means of partition 12, the casing 1 is divided into the camshaft chamber 6 and an oil discharge chamber 13, from which the lubricating oil is returned in a conventional manner to the oil pan 7. The overflow port 11 has a trapezoidal configuration which flares toward the side facing toward the camshaft in the manner of a conical shape, extends approximately in parallel to the axis C of the camshaft 2, and is preferably arranged centrally between the walls 8 in the camshaft chambers 6. In the illustrated example, the trapezoidal overflow port has a major surface 14 and lateral surfaces 15 and 16, and merges into a subsequently cylindrical configuration 17. Shifts in the oil level within the camshaft chamber when the vehicle travels up or down an incline are characterized by the oil level lines 18 and 19 (FIG. 2*b*).

When the vehicle travels straight ahead, the oil level in the camshaft chamber 6 assumes the position illustrated by the oil level line 10. In contrast thereto, if the vehicle travels up a mountain road, the oil level assumes the position shown by oil level line 18, and if the vehicle travels downward along an incline, the oil level assumes the position illustrated by the oil level line 19. Due to the special configuration of the illustrated overflow port 11, a discharge of the lubricating oil via the overflow port from the camshaft chamber is safely avoided by the lateral surfaces 15 and 16 when the vehicle moves up or down an incline, up to a percentage which can be influenced by the position of the lateral surfaces.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. In a casing for the lubrication of a camshaft of an internal combustion engine for automotive vehicles of the V-type having a top-positioned camshaft construction, said casing being filled partially with lubricating oil to effect splash lubrication of cams carried by said camshaft and being provided with at least one lateral overflow port to maintain the oil at a constant level, the improvement wherein said overflow port has a configuration which flares outwardly in a direction toward a side of the casing facing the camshaft and extends at least approximately in parallel to the longitudinal camshaft and extends at least approximately in parallel to the longitudinal camshaft axis, and a trapezoidal configuration flaring toward a side of the casing facing away from the camshaft and merging into a cylindrical configuration.

2. In a casing for the lubrication of a camshaft of an internal combustion engine for an automotive vehicle of the type having at least one lateral overflow port for removing oil in excess of a predetermined level from said casing, the improvement comprising said overflow port having a shape which acts so as to prevent removal of oil not in excess of said predetermined level due to uphill or downhill inclination of said vehicle, said shape comprising a trapezoidal configuration flaring toward a side of the casing facing away from the camshaft and merging into a cylindrical configuration.

3. A casing according to claim 2, wherein a horizontal lower wall of said trapezoidal configuration corresponds to said predetermined level when said vehicle is level, said lower wall being flanked by inclined walls of said trapezoidal configuration corresponding to said predetermined level when said vehicle is in uphill and downhill orientations, respectively.

* * * * *